US008784642B2

(12) United States Patent
Andoh et al.

(10) Patent No.: US 8,784,642 B2
(45) Date of Patent: Jul. 22, 2014

(54) LUBRICATING OIL COMPOSITION FOR LUBRICATING AUTOMOTIVE ENGINES

(75) Inventors: Hiroki Andoh, Shizuoka (JP); Morikuni Nakazato, Shizuoka (JP)

(73) Assignee: Chevron Japan Ltd., Tokyo (JP)

( * ) Notice: Subject to any disclaimer, the term of this patent is extended or adjusted under 35 U.S.C. 154(b) by 20 days.

(21) Appl. No.: 13/294,910

(22) Filed: Nov. 11, 2011

(65) Prior Publication Data

US 2012/0132166 A1 May 31, 2012

(30) Foreign Application Priority Data

Nov. 29, 2010 (JP) ..... 2010-265479

(51) Int. Cl.

| | |
|---|---|
| ***C10G 71/00*** | (2006.01) |
| ***C10M 137/10*** | (2006.01) |
| ***C10M 159/24*** | (2006.01) |
| ***F02B 43/00*** | (2006.01) |

(52) U.S. Cl.

USPC ..... 208/18; 208/19; 508/369; 508/391; 123/1 A

(58) Field of Classification Search

CPC ..... C10M 2203/1006; C10M 2203/1025; C10M 2215/28; C10M 2215/08; C10M 2217/043; C10M 2205/173; C10M 2207/028; C10M 2207/262; C10M 2219/046; C10M 2207/026; C10M 2215/064; C10M 2223/041; C10M 2223/043; C10M 2223/045; C10M 2209/084

USPC ..... 508/369, 391; 123/1 A; 208/18, 19

See application file for complete search history.

(56) References Cited

U.S. PATENT DOCUMENTS

| | | | | |
|---|---|---|---|---|
| 6,232,279 | B1 * | 5/2001 | Steigerwald | 508/591 |
| 7,067,049 | B1 | 6/2006 | Baillargeon et al. | |
| 2003/0162673 | A1 * | 8/2003 | Kurihara et al. | 508/364 |
| 2003/0216266 | A1 * | 11/2003 | Hirano et al. | 508/291 |

FOREIGN PATENT DOCUMENTS

| | | | |
|---|---|---|---|
| EP | 1361263 | A1 | 11/2003 |
| EP | 2009084 | A1 | 12/2008 |
| EP | 2177596 | A1 | 4/2010 |
| EP | 2241611 | A1 | 10/2010 |
| JP | 1994-306384 | A | 11/1994 |
| JP | 2000-087070 | A | 9/1998 |
| JP | 2003-505533 | A | 2/2003 |

* cited by examiner

*Primary Examiner* — Vishal Vasisth
(74) *Attorney, Agent, or Firm* — Joseph P. Foley

(57) ABSTRACT

A lubricating oil composition of SAE viscosity grade 0W20 which comprises a base oil and additive components comprising a nitrogen-containing ashless dispersant, an alkaline earth metal-containing detergent, a phosphorus-containing wear inhibitor, an oxidation inhibitor and a viscosity index improver and which shows a viscosity index of 200-240, a HTHS viscosity of not less than 2.9 mPa·s s at 150° C. and a Noack evaporation loss of not more than 13% favorably gives a high fuel economy and high wear inhibition to a four cycle gasoline engine of motorcycles and a diesel engine mounted on motor cars equipped with an exhaust gas post-processing apparatus.

11 Claims, No Drawings

LUBRICATING OIL COMPOSITION FOR LUBRICATING AUTOMOTIVE ENGINES

FIELD OF THE INVENTION

The present invention relates to a lubricating oil composition of low viscosity type for lubricating automotive engines, which shows good fuel economy. In more detail, the invention is directed to a lubricating oil composition of a low viscosity type for lubricating automotive engines which shows high wear inhibition performance, though which gives good fuel economy. In particular, the lubricating oil composition of the invention is favorably employable for lubricating a four cycle gasoline engine of motorcycles and a diesel engine mounted on motor cars equipped with an exhaust gas post-processing apparatus.

BACKGROUND OF INVENTION

Recently, the demand for enhancing fuel economy of automobiles has prominently increased. As the lubricating oil compositions to be used for lubricating engines mounted in gasoline engine-mounted automobiles and diesel engine-mounted automobiles, engine oils of a low viscosity type giving good fuel economy have been required. At present, a lubricating oil composition of SAE viscosity grade of 0W20 showing a high temperature-high shear viscosity (HTHS viscosity determined at 150° C. under the condition of a shear rate of $10^6$/s) of approx. 2.6 mPa·s is employed in practice.

It is noted, however, that the engine oils for four cycle gasoline engines of motorcycles are also employed for lubricating transmission system. Therefore, increase of wear (namely, lowering of anti-wear performance) of transmission gears and the like of the transmission system may be problematic. In consideration of these possible troubles, JASO T903-2006 indicates that the engine oils for four cycle gasoline engines of motor cycles should have a HTHS viscosity (at $10^6$/s) of 2.9 mPa·s or higher. It has been noted, however, that the known engine oils of SAE viscosity grade 0W20 cannot give such high temperature-high shear viscosity. For this reason, the conventional engine oils of low viscosity type for four cycle gasoline engines of motorcycles only satisfy SAE viscosity grade of 10W30, 5W30 or 0W30.

As for engine oils for diesel engines mounted on motor cars equipped with a diesel particulate filter, ACEA C1-08 & C2-08, that is, European Specifications for the engine oils, indicate that the lower limit of the high temperature high shear viscosity (at $10^6$/s) is 2.9 mPa·s s and that the upper limit of Noack evaporation loss is 13%.

Patent Publication JP 6-306384A describes a fuel economy type-lubricating oil for internal combustion engines comprising a mineral base oil showing a kinematic viscosity of 3-5 cST (at 100° C.), a viscosity index of 135 or higher, and a paraffin/total hydrocarbon ratio (namely, % Cp) of 90% or more and a specific amount of an organic molybdenum compound.

Patent Publication JP 2003-505533A describes a low-volatile fuel economy type lubricating oil composition showing NOACK volatility of 15 wt. % or less, which comprises at least 50 wt. % of a mineral oil, at least 95 wt. % of a saturated product and not more than 25 wt. % of naphthenes, which shows a kinematic viscosity of 4.0-5.5 $mm^2$/s, a viscosity index of at least 120 and NOACK volatility of 15.5 wt. % or less, a specific amount of a calcium-containing detergent and a specific amount of an oilsoluble organic friction modifier.

Patent Publication JP 2000-87070A describes an engine oil composition for four cycle engine motorcycles showing low oil consumption and good fuel economy, which comprises a hydrocarbon base oil showing a kinematic viscosity of 3-10 $mm^2$/s (at 100° C.) and a viscosity index of 120 or higher or a mixed base oil containing 15 wt. % of more of the hydrocarbon base oil, a zinc dialkyldithiophosphate, a metal-containing detergent, an ashless dispersant, a friction modifier and a viscosity index improver (which imparts a kinematic viscosity of 9.3-16.5 $mm^2$/s at 100° C. to the oil composition). Patent Publication JP 2000-87070A further describes engine oil compositions of SAE viscosity grade of 10W30 and 10W40 for four cycle engine motorcycles.

SUMMARY OF THE INVENTION

It is known that not only improvement of engine structure but also use of a lubricating oil composition having a low viscosity is effective to increase fuel economy of automotive engines. Therefore, as described herein before, a lubricating oil composition of SAE viscosity grade of 0W20 showing a HTHS viscosity (at $10^6$/s) of approximately 2.6 mPa·s s is employed in practice. However, since this fuel economy type gasoline engine oil of SAE viscosity grade of 0W20 for four-wheel passenger cars does not show a satisfactorily high HTHS viscosity, there probably raises a problem in wear inhibition when the fuel economy type gasoline engine oil of SAE viscosity grade of 0W20 is employed for four-cycle gasoline engines of motorcycles in which the engine oil is also used for lubricating the transmission system.

It has been found by the study of the present inventors that a lubricating oil composition of SAE viscosity grade of 0W20 which shows a viscosity index in the range of 200 to 240, a high HTHS viscosity (at 150° C. and $10^6$/s) such as 2.9 mPa·s s or higher, a Noack evaporation loss of 13% or less, and a satisfactorily high wear inhibition can be produced by the use of a base oil showing an extremely high viscosity index such as in the range of approximately 133 to 160 which is prepared by subjecting slack wax or synthetic wax obtained by Fischer-Tropsh process to a hydrogenation-isomerization process, distillation and dewaxing and has recently become available on market, as well as optimization of an additive composition and additive contents.

The invention disclosed herein has been based on the above-mentioned finding.

It should be noted that a lubricating oil composition of SAE viscosity grade of 0W20 gives good fuel economy for the reason of a relatively low kinematic viscosity at either a high temperature or a low temperature.

Accordingly, there is provided by the present invention a lubricating oil composition of SAE viscosity grade 0W20 for lubricating automotive engines which comprises a base oil and the below-described additive components and which shows a viscosity index in the range of 200 to 240, a high temperature-high shear viscosity (i.e., HTHS viscosity) of not less than 2.9 mPa·s s at 150° C. and a Noack evaporation loss of not more than 13%:

a) a nitrogen-containing ashless dispersant in an amount of 0.01-0.3 wt. % in terms of nitrogen content;

b) an alkaline earth metal-containing detergent in an amount of 0.08-0.3 wt. % in terms of alkaline earth metal content;

c) a phosphorus-containing wear inhibitor in an amount of 0.05-0.12 wt. % in terms of phosphorus content;

d) an oxidation inhibitor selected from the group consisting of amine compounds, phenol compounds, and molybdenum compounds, in an amount of 0.01-7 wt. %, and e) a viscosity index improver in an amount of 0.5-20 wt. %.

In the above-described lubricating oil composition, the amounts of the additive components are in terms of wt. % based on a total amount of the oil composition.

The lubricating oil composition of SAE viscosity grade 0W20 according to the invention means a lubricating oil composition satisfying the viscosity property for "0W20" described in "SAE Viscosity Grades for Engine Oils" issued (updated in 2007) by API. The high shear viscosity means a shear viscosity determined at the shear rate of $10^6$/s.

There is also provided by the invention a method of lubricating a diesel engine mounted on motor cars equipped with an exhaust gas post-processing apparatus using a lubricating oil composition of the invention.

The lubricating oil composition of the invention of SAE viscosity grade 0W20 shows such a high HTHS viscosity as 2.9 m Pa·s or higher and hence shows good fuel economy and good wear inhibition. Accordingly, the lubricating oil composition of the invention is favorably employable for lubricating a four cycle gasoline engine of motorcycles as well as a diesel engine of automotives equipped with an exhaust gas post-processing apparatus.

DETAILED DESCRIPTION OF THE INVENTION

The preferred embodiments of the lubricating oil composition according to the invention are described below.

(1) The lubricating oil composition shows a kinematic viscosity of not lower than 8.5 $mm^2$/s but not higher than 9.3 $mm^2$/s (2) The base oil comprises a mineral base oil showing a kinematic viscosity in the range of 2 to 9 $mm^2$/s at 100° C. and a viscosity index in the range of 133 to 160.

(3) The base oil contains not less than 80 wt. % of a mineral base oil showing a kinematic viscosity in the range of 2 to 9 $mm^2$/s at 100° C. and a viscosity index in the range of 133 to 160.

(4) The base oil shows a viscosity index in the range of 133 to 160 and is produced by subjecting slack wax or synthetic wax obtained by Fischer-Tropsch process to a hydrogenation-isomerization process, distillation and dewaxing.

(5) The base oil is a mixture of two or more base oil components having a viscosity index of 130 or more but having a different viscosity.

(6) The lubricating oil composition contains an organic sulfur-containing compound.

(7) The nitrogen-containing ashless additive comprises a succinimide compound having bis-structure.

(8) The alkaline earth metal-containing detergent comprises an over-based calcium-containing compound selected from the group consisting of an over-based calcium sulfonate and an over-based calcium phenate.

(9) The phosphorus-containing wear inhibitor comprises a phosphorus-containing compound is selected from the group consisting of zinc dihydrocarbyldithiophosphate and zinc dihydrocarbylphosphate.

(10) The viscosity index improver comprises a polymethacrylate viscosity index improver.

(11) The lubricating oil is used for lubricating motorcycles equipped with a four cycle gasoline engine.

(12) The lubricating oil composition is used for lubricating a diesel engine mounted on motor cars equipped with an exhaust gas post-processing apparatus.

The base oil and additive components used for formulating the lubricating oil composition of the invention are described below in more detail.

Base Oil

The base oil of the lubricating oil composition according to the invention preferably is a mineral oil. Alternatively, the base oil can be a mixture of a relatively large amount (not less than 50 wt. %) of a mineral oil and a relatively small amount (less than 50 wt. %) of a synthetic oil.

The base oil for the lubricating oil composition of the invention preferably is a base oil (specifically a mineral oil) that has a saturated hydrocarbon content of 95 wt. % or more, particularly 98 wt. % or more, and shows a kinematic viscosity in the range of 2 to 9 $mm^2$/s and a viscosity index of 133 or higher (particularly 135 or higher, further particularly 145 or higher). The preferred base oil may be a single base oil or a mixture of two or more base oils. The preferred base oil can be mixed with a small amount of a base oil having a different composition and showing different characteristics. However, it is preferred that the mixture of base oils has the above-mentioned preferred composition and shows the above-mentioned preferred characteristics.

The above-mentioned preferred base oil preferably shows an evaporation loss (according to ASTM D5800) of 16% or less, more preferably 15% or less, further preferably 13% or less. If the engine oil (i.e., lubricating oil composition) employs a base oil showing a high evaporation loss, the engine oil shows high oil consumption and high viscosity increase when the engine oil is kept at elevated temperatures. Thus, the fuel economy decreases.

There are no specific limitations with respect to the origin of the desired base oil. The base oil, however, preferably is a base oil having a high viscosity index in the range of 133-160, which is produced by subjecting slack wax or synthetic wax obtained from natural gas by Fischer-Tropsch process to a hydrogenation-isomerization process, distillation and dewaxing, in the case that the base oil is a mineral base oil. The above-mentioned high viscosity index base oil is preferably employed for the preparation of the lubricating oil composition of the invention, because the base oil shows a high kinematic viscosity at 100° C. and a good low temperature viscosity characteristic and lowers the evaporation loss of the oil composition.

The above-mentioned mineral base oil having a high viscosity index can be used in a mixture with a synthetic oil. The synthetic oil preferably shows the above-mentioned preferred characteristics. The preferred synthetic oil can be selected from a variety of known synthetic oils. Examples of the known synthetic oils include esters, alkylbenzenes, and poly-α-olefins (PAOs). Most preferred is poly-α-olefins (PAOs).

Nitrogen-Containing Ashless Dispersant

The lubricating oil composition of the invention contains a nitrogen-containing ashless dispersant (component (a)) in an amount of 0.01 to 0.3 wt. % in terms of nitrogen content. The nitrogen-containing ashless dispersant preferably has a weight average molecular weight in the range of 4,500 to 20,000. The "weight average molecular weight" used herein means a molecular weight determined by GPC analysis (reference material: polystyrene).

Examples of the nitrogen-containing ashless dispersants include an alkenyl- or alkyl-succinimide (wherein the alkenyl or alkyl group is derived from polyolefin) or its derivatives. The nitrogen-containing ashless dispersant is preferably contained in the lubricating oil composition in an amount of 0.01 to 0.3 wt. %, based on the total amount of the lubricating oil composition. A representative succinimide dispersant can be prepared from a succinic anhydride having a high molecular weight alkyl or alkenyl substituent and a polyalkyleneamine containing average 4-10 nitrogen atoms, preferably 5-7 nitrogen atoms, per one molecule. The high molecular weight alkyl or alkenyl substituent is preferably derived from polyalkene, particularly polybutene, having a number average molecular weight of approx. 900 to 5,000.

The process for obtaining the polybutenyl-succinic acid anhydride by the reaction of polybutene and maleic anhydride is generally performed by the chlorination process using a chloride compound. The chlorination process is advantageous in its reaction yield. However, the reaction product obtained by the chlorination process contains a large amount (for instance, approx. 2,000 ppm) of chlorine. If the thermal reaction process using no chloride compound is employed, the reaction product contains only an extremely small chlorine (for instance, 30 ppm or less). Moreover, if a highly reactive polybutene (containing a methylvinylidene structure at least approx. 50%) is employed in place of the conventional polybutene (mainly containing a α-olefin structure), even the thermal reaction process can give a high reaction yield. If the reaction yield is high, the reaction product necessarily contains a reduced amount of the unreacted polybutene. This means that a dispersant containing a large amount of the effective component (succinimide) is obtained. Accordingly, it is preferred that the polybutenyl succinic acid anhydride is produced from the highly reactive polybutene by the thermal reaction and that the produced polybutenyl succinic acid anhydride is reacted with polyalkylenepolyamine having an average nitrogen atom number in the range of 4 to 10 (in one molecule) to give the succinimide. The succinimide further can be reacted with boric acid, alcohol, aldehyde, ketone, alkylphenol, cyclic carbonate, organic acid or the like, to give a modified succinimide. Particularly, a borated alkenyl(or alkyl)-succinimide which is obtained by the reaction with boric acid or a boron compound is advantageous from the viewpoints of thermal and oxidation stability. The succinimide can be one of mono-type, bis-type and poly-type which are named according to the imide structure(s) contained in the succinimide molecule. The succinimide of bis-type or poly-type can be preferably employed as the ashless dispersant in the lubricating oil composition of the invention.

Other examples of the nitrogen-containing ashless dispersants include polymeric succinimide dispersants derived from ethylene-α-olefin copolymer (for instance, the molecular weight is 1,000 to 15,000), and alkenylbenzyl amine ashless dispersants.

In the lubricating oil composition of the invention, the nitrogen-containing ashless dispersant can be replaced with a nitrogen-containing dispersant-type viscosity index improver. As the nitrogen-containing dispersant-type viscosity index improver, a nitrogen-containing olefin copolymer or a nitrogen-containing polymethacrylate each having a weight mean molecular weight of 90,000 or more (in terms of polystyrene converted-molecular weight determined by GPC analysis). In consideration of thermal stability, the former nitrogen-containing olefin copolymer is advantageous.

The lubricating oil composition of the invention necessarily contains the nitrogen-containing ashless dispersant and/or the nitrogen-containing dispersant-type viscosity index improver. If desired, the other ashless dispersants such as an alkenylsuccinic acid ester dispersant can be employed in combination.

Metal-Containing Detergent

The lubricating oil composition of the invention contains an alkaline earth metal-containing detergent (component (b)) in an amount of 0.08 to 0.3 wt. % in terms of alkaline earth metal content. Examples of the alkaline earth metals include calcium, barium and magnesium. Preferred is calcium. The alkaline earth metal-containing detergent preferably is an alkaline earth metal sulfonate or an alkaline earth metal phenate. The alkaline earth metal sulfonate and alkaline earth metal phenate can be employed in combination. In addition, these metal-containing detergents can be used in combination with other metal-containing detergent such as an alkaline earth metal (particularly calcium) salt of an alkylsalicylate and/or an alkylcarboxylate.

As the calcium sulfonate, there are known overbased calcium sulfonates having a TBN in the range of 150 to 500 mgKOH/g and low base number calcium sulfonates having a TBN in the range of 5 to 60 mgKOH/g. The overbased calcium sulfonate preferably is an overbased calcium salt of an alkylated benzenesulfonate having an alkyl group of 10 or more carbon atoms and an overbased calcium salt of an alkylated toluenesulfonate having an alkyl group of 10 or more carbon atoms. The degree of the overbasing preferably is in the range of 5 to 25. The low base number calcium sulfonate preferably is a calcium salt of an alkylated benzenesulfonate or a calcium salt of an alkylated benzenesulfonate. The alkyl group preferably contains 10 or more carbon atoms. The low base number calcium sulfonate preferably is a neutral salt or the like (preferably having an overbasing degree in the range of 0.1 to 1.5) having been subjected to no overbasing process. Preferred is a combination of an overbased calcium sulfonate and a low base number calcium sulfonate. The sulfonate can be a synthetic sulfonate or a petroleum-origin sulfonate which is prepared by the steps of sulfonating a lubricating oil fraction of a mineral oil and reacting it with a calcium compound. Therefore, the low base number calcium sulfonate and/or the overbased calcium sulfonate derived from petroleum products can also be favorably employed.

As the calcium phenates, there are known overbased sulfurized calcium phenates having a TBN of 120-350 mgKOH/g. Preferred is an overbased sulfurized calcium phenate having an alkyl group of 10 carbon atoms or more.

Phosphorus-Containing Wear Inhibitor

The lubricating oil composition of the invention contains a phosphorus-containing wear inhibitor (component (c)) in an amount of 0.05 to 0.12 wt. % in terms of phosphorus content. The phosphorus-containing wear inhibitor preferably is zinc dihydrocarbyldithiophosphate or a zinc dihydrocarbylphosphate, both of which are known as multifunctional lubricating oil additives showing oxidation inhibition performance and wear inhibition performance.

The zinc dihydrocarbyldithiophosphate generally is a zinc dialkyldithiophosphate having a primary alkyl or a secondary alkyl. From the viewpoint of anti-wear performance, preferred is a zinc dialkyldithiophosphate having a secondary alkyl group which is derived from a secondary alcohol having 3 to 18 carbon atoms. In contrast, a zinc dialkyldithiophosphate having a primary alkyl group which is derived from a primary alcohol having 3 to 18 carbon atoms is advantageous in its excellent heat resistance and friction reducing function. The zinc dialkyldithiophosphate having a secondary alkyl group and the zinc dialkyldithiophosphate having a primary alkyl group can be used in combination. A zinc dialkyldithiophosphate having a primary alkyl group and a secondary alkyl group which can be obtained from a mixture of a primary alcohol and a secondary alcohol can also be favorably employed.

In addition, a zinc dialkylaryldithiophosphate (e.g., zinc dialkylaryldithiophosphate obtainable using dodecylphenyl) can be employed.

Otherwise, the phosphorus-containing wear inhibitor can be a phosphorus ester, a phosphite ester, or a thiophosphate ester.

Oxidation Inhibitor

The lubricating oil composition of the invention further contains at least one oxidation inhibitor (component (d))

selected from the group consisting of phenol compounds (phenolic oxidation inhibitors), amine compounds (amine oxidation inhibitors), and molybdenum compounds (molybdenum oxidation inhibitors) in an amount of 0.1 to 7 wt. %.

A representative phenolic oxidation inhibitor is a hindered phenol compound, and a representative amine oxidation inhibitor is a diarylamine compound.

The hindered phenol compound and diarylamine compound are advantageous because both further provide high detergency at high temperatures. The diarylamine oxidation inhibitor is particularly advantageous because it has a base number derived from the contained nitrogen which serves to increase detergency at high temperatures. In contrast, the hindered phenol oxidation inhibitor is effective to reduce oxidative deterioration caused by $NO_x$.

Examples of the hindered phenol oxidation inhibitors include 2,6-di-t-butyl-pcresol, 4,4'-methylenebis(2,6-di-t-butylphenol), 4,4'-methylenebis(6-t-butyl-o-cresol), 4,4'-isopropylidenebis(2,6-di-t-butylphenol), 4,4'-bis(2,6-di-t-butylphenol), 2,2'-methylenebis(4-methyl-6-t-butylphenol), 4,4'-thiobis(2-methyl-6-t-butylphenol), 2,2-thio-diethylenebis[3-(3,5-di-t-butyl-4-hydroxyphenyl)propionate], octyl 3-(3,5-di-t-butyl-4-hydroxyphenyl)propionate, octadecyl 3-(3,5-di-t-butyl-4-hydroxyphenyl)propionate, and octyl 3-(5-t-butyl-4-hydroxy-3-methylphenyl)propionate.

Examples of the diarylamine oxidation inhibitors include alkyldiphenylamine having a mixture of alkyl groups of 4 to 9 carbon atoms, p,p'-dioctyldiphenylamine, phenyl-1-naphthylamine, phenyl-2-naphthylamine, alkylated N-naphthylamine, and alkylated phenyl-1-naphthylamine The molybdenum oxidation inhibitor can be an oxymolybdenum complex of a basic nitrogen compound. Preferred examples of the oxymolybdenum complex of a basic nitrogen compound include an oxymolybdenum complex of succinimide and an oxymolybdenum complex of carboxylamide.

The oxymolybdenum complex of a basic-nitrogen compound can be prepared by the following process:

an acidic molybdenum compound or its salt is caused to react with a basic nitrogen-containing compound such as succinimide, carboxylamide, hydrocarbyl monoamine, hydrocarbyl polyamine, Mannich base, phosphonamide, thiophosphonamide, phosphoramide and a dispersant-type viscosity index improver (or a mixture thereof) at a temperature of 120° C. or lower.

Molybdenum-containing compounds other than the above-mentioned oxymolybdenum complex of a basic nitrogen compound can be employed in place of the oxymolybdenum complex of a basic nitrogen compound or in combination with the oxymolybdenum complex of a basic nitrogen compound. The above-mentioned "other molybdenum-containing compound" can be sulfurized oxymolybdenum dithiocarbamate or sulfurized oxymolybdenum dithiophosphate.

Each of the phenolic oxidation inhibitor (particularly, hindered phenol oxidation inhibitor), amine oxidation inhibitor (particularly, diarylamine oxidation inhibitor) and a molybdenum oxidation inhibitor (particularly, oxymolybdenum complex of a basic nitrogen compound) can be employed singly or in combination. If desired, other oil soluble oxidation inhibitors can be employed in combination with the above-mentioned oxidation inhibitor(s).

Viscosity Index Improver

The lubricating oil composition of the invention further contains a viscosity index improver (component (e)) in an amount of 0.5 to 20 wt. %. Examples of the viscosity index improvers include polymethacryl viscosity improvers such as polyalkyl methacrylate and olefin copolymer viscosity index improvers such as ethylene-propylene copolymer, styrene-butadiene copolymer, and polyisoprene. The viscosity index improvers can be used singly or in combination.

Organic Sulfur Compound

The lubricating oil composition of the invention preferably contains an organic sulfur compound which is effective in wear inhibition and oxidation inhibition. Examples of the organic sulfur compounds include sulfurized olefin, sulfurized ester, sulfurized oil/fat, polysulfide, dimercaptothiazole, dithiophosphate ester, and dithiocarbamate.

Other Additives

The lubricating oil composition of the invention may further contain an alkali metal borate hydrate for increasing high temperature detergency and a basic number. The alkali metal borate hydrate can be contained in an amount of 5 wt. % or less, particularly 0.01 to 5 wt. %. Some alkali metal borate hydrates contain an ash component and a sulfur component. Therefore, the alkali metal borate hydrate can be used in an appropriate amount in consideration of the composition of the resulting lubricating oil composition.

The lubricating oil composition of the invention may further contain a small amount of various auxiliary additives. Examples of the auxiliary additives are described below.

Zinc dithiocarbamate or methylenebis(dibutyl dithiocarbamate) as an oxidation inhibitor or a wear inhibitor; an oil soluble copper compound; organic amide compounds (e.g., oleylamide); benzotriazol compounds and thiadiazol compounds functioning as metal deactivating agent; nonionic polyoxyalkylene surface active agents such as polyoxyethylene alkylphenyl ether and copolymers of ethylene oxide and propylene oxide functioning as rust inhibitor and anti-emulsifying agent; a variety of amines, amides, amine salts, their derivatives, aliphatic esters of polyhydric alcohols, and their derivatives which function as friction modifiers; and various compounds functioning as anti-foaming agents and pour point depressants.

The auxiliary additives can be preferably incorporated into the lubricating oil composition in an amount of 3 wt % or less (particularly, 0.001 to 3 wt. %).

EXAMPLES

The present invention is further described by the following illustrative non-limiting examples.

Examples 1, 2, Comparison Example & Reference Example

(1) Preparation of Lubricating Oil Composition

A lubricating oil composition of the invention (SAE viscosity grade: 0W20, High temperature high shear viscosity: 2.9 mPa·s or higher) was prepared using the following additives and base oil in Examples 1 and 2. In the comparison example, a lubricating oil composition (SAE viscosity grade: 0W20, High temperature high shear viscosity: 2.6 mPa·s) was prepared. In the reference example, a lubricating oil composition (SAE viscosity grade: 10W30, High temperature high shear viscosity: 2.9 mPa·s or higher) was prepared.

(2) Base Oil

Base oil-1: a mixture of base oil (a) and base oil (b) in a weight ratio of 60:40 (base oil (a):base oil (b), viscosity index: 142; kinematic viscosity at 100° C.: 4.9 $mm^2/s$; Noack evaporation loss: 10.1%) in which the base oil (a) was a mineral oil-origin base oil prepared by subjecting slack wax to hydrogenation-isomerization, distillation and dewaxing (viscosity index: 137; kinematic viscosity at 100° C.: 4.1 $mm^2/s$; Noack evaporation loss: 13.6%) and base oil (b) was a mineral oil-origin base oil prepared by subjecting slack wax to hydrogenation-isomerization, distillation and dewaxing; viscosity index: 148; kinematic viscosity at 100° C.: 6.6 $mm^2/s$, Noack evaporation loss: 5.0%).

Base oil-2: hydrocracked mineral oil (viscosity index: 128; kinematic viscosity at 100° C.: 4.2 $mm^2/s$, Noack evaporation loss: 14.2%).

Base oil-3: a mixture of hydrocracked mineral oil (a) and hydrocracked mineral oil (b) in a weight ratio of 73:27 (mineral oil (a):mineral oil (b); viscosity index: 115; kinematic viscosity at 100° C.: 6.7 $mm^2/s$, Noack evaporation loss: 10.8%) in which the hydrocracked mineral oil (a) had viscosity index: 122; kinematic viscosity at 100° C.: 5.6 $mm^2/s$, Noack evaporation loss: 12.4%, and the hydrocracked mineral oil (b) had viscosity index: 99; kinematic viscosity at 100° C.: 10.7 $mm^2/s$, Noack evaporation loss: 6.0%.

Remarks: The base oil was used in an amount to give in combination with the additives a total 100 wt. % of the lubricating oil composition.

(3) Additives

[Nitrogen-Containing Ashless Dispersant]

1) Ashless dispersant-1 (weight average molecular weight: 5,100, nitrogen content: 1.95 wt. %, boron content: 0.63 wt. %, chlorine content: less than 5 wt.ppm., prepared by the steps of thermally reacting a highly reactive polyisobutene having a number average molecular weight of approx. 1,300 (containing at least approx. 50% of methylvinylidene structure) with maleic anhydride to give polyisobutenylsuccinic anhydride, reacting the polyisobutenylsuccinic anhydride with polyalkylenepolyamine having an average nitrogen atoms of 6.5 (per one molecule) to give a bis-succinimide, and reacting the bis-succinimide with boric acid): 0.06 wt. % (in terms of nitrogen content)

2) Ashless dispersant-2 (weight average molecular weight: 12,800 (GPC analysis, value as molecular weight corresponding to polystyrene), nitrogen content: 1.0 wt. %, chlorine content: 30 wt.ppm., prepared by the steps of thermally reacting a highly reactive polyisobutene having a number average molecular weight of approx. 2,300 (containing at least approx. 50% of methylvinylidene structure) with maleic anhydride to give polyisobutenylsuccinic anhydride, reacting the polyisobutenylsuccinic anhydride with polyalkylenepolyamine having an average nitrogen atoms of 6.5 (per one molecule) to give a bis-succinimide, and reacting the bis-succinimide with ethylene carbonate): 0.01 wt. % (in terms of nitrogen content)

[Alkaline Earth Metal-Containing Detergent]

1) Overbased calcium phenate (sulfurized phenate having a $C_{12}$ branched alkyl group, Ca: 9.6 wt. %, S: 3.4 wt. %, TBN: 264 mgKOH/g): 0.15 wt. % (in terms of Ca content)

2) Overbased calcium sulfonate (alkyltoluene sulfonate having $C_{20-24}$ alkyl group, Ca: 16.0 wt. %, S: 1.6 wt. %, TBN: 425 mgKOH/g, overbasing degree: 19): 0.07 wt. % (in terms of Ca content)

3) Low basic calcium sulfonate (alkylbenzene sulfonate having $C_{14-24}$ alkyl group, Ca: 2.4 wt. %, S: 2.9 wt. %, TBN: 17 mgKOH/g, overbasing degree: 0.34): 0.01 wt. % (in terms of Ca content)

[Zinc Dithiophosphate]

Zinc di(secondary alkyl)dithiophosphate (P: 7.2 wt. %, Zn: 7.8 wt. %, S: 14 wt. %, prepared by using a secondary alcohol having 3 to 8 carbon atoms): 0.06 wt. % (in terms of P content)

Zinc di(primary alkyl)dithiophosphate (P: 7.3 wt. %, Zn: 8.4 wt. %, S: 14 wt. %, prepared by using a primary alcohol having 8 carbon atoms): 0.03 wt. % (in terms of P content)

[Oxidation Inhibitor]

Dialkyldiphenylamine having a mixture of $C_4$ and $C_8$ alkyl groups (N: 4.6 wt. %): 0.45 wt. %

[Organic Sulfur Compound]—Used in Example 2 Only

Sulfurized isobutylene (S: 42 wt. %): 0.3 wt. %

[Viscosity Index Improver]

Polymethacrylate viscosity index improver (SSI=23) used in Example 1 (amount: 5.4 wt. %), Example 2 (amount: 5.5 wt. %), and Comparison Example (amount: 5.0 wt. %)

Ethylene-propylene copolymer viscosity index improver (SSI=24) used in Reference Example (amount: 4.5 wt. %)

[Pour Point Depressant]

Polymethacrylate pour point depressant: 0.3 wt. %

[Auxiliary Additives]

Combination of small amounts of a friction modifier, a rust inhibitor, a defoamer, etc.: 0.6 wt. % for all examples Evaluations of Lubrication Oil Compositions Each of the lubricating oil compositions was subjected to Shell Four Ball Test under the conditions of oil temperature of 75° C., load of 40 kgf, and rotation for 60 minutes at 1,200 rpm, to evaluate its wear inhibition property. The wear inhibition property was evaluated by determining a wear mark formed on the surfaces of the tested balls.

Table 1 shows physical properties of the lubricating oil compositions of Examples 1, 2, Comparison Example, and Reference Example.

TABLE 1

| | Ex. 1 | Ex. 2 | Com. Ex. | Ref. Ex. |
|---|---|---|---|---|
| SAE | 0W20 | 0W20 | 0W20 | 10W30 |
| Base oil | Base oil-1 | Base oil-1 | Base oil-2 | Base oil-3 |
| HTHS viscosity | 2.97 | 3.00 | 2.62 | 3.15 |
| Kinematic viscosity | | | | |
| at 100° C. | 9.16 | 9.20 | 8.02 | 10.1 |
| at 40° C. | 41.9 | 42.2 | 36.3 | 65.7 |
| Viscosity index | 209 | 209 | 203 | 139 |
| Cranking viscosity | | | | |
| at −25° C. | — | — | — | 5815 |
| at −35° C. | 5854 | 5859 | 5254 | — |
| Pumping viscosity | Pass (−40° C.) | Pass (−40° C.) | Pass (−40° C.) | Pass (−30° C.) |
| Noack evaporation loss (%) | 9.9 | 10.3 | 14.0 | 11.5 |
| Shell wear test, Average wear diameter (mm) | 0.49 | 0.48 | 0.55 | 0.49 |

Remarks:

HTHS viscosity: viscosity (unit: mPa · s, determined at 150° C. at a shear rate of $10^6/s$.

Kinematic viscosity: unit $mm^2/s$

Cranking viscosity: unit mPa · s

"Pass" for Pumping viscosity means that the lubricating oil composition satisfies the pumping viscosity at −40° C. which is indicated for SAE 0W20 or the pumping viscosity at −30 °C. which is indicated for SAE 10W30.

The results set forth in Table 1 indicate the following:

(1) The lubricating oil compositions of Examples 1 and 2 according to the invention show wear inhibition property similar to that shown by the SAE 10W30 lubricating oil composition of Reference Example, though the lubricating oil compositions of Examples 1 and 2 are SAE 0W20 oils.

(2) The lubricating oil composition of Comparison Example of SAE 0W20 shows high Noack evaporation loss, low high temperature high shear viscosity, and low wear inhibition.

What is claimed is:

1. A lubricating oil composition having an SAE viscosity grade of 0W20 and having a kinematic viscosity at 100° C. of no less than 8.5 $mm^2/s$ and no greater than 9.3 $mm^2/s$, a viscosity index in the range of 200 to 240, a high temperature-high shear viscosity of not less than 2.9 mPa·s at 150° C. and a Noack evaporation loss of not more than 13% for lubricating automotive engines wherein said lubricating oil composition comprises a base oil containing not less than 80 wt. % of a mineral base oil showing a kinematic viscosity in the range of 2 to 9 $mm^2/s$ at 100° C. and a viscosity index in the range of 133 to 160, and the below-described additive components:

a) nitrogen-containing ashless dispersant in an amount of 0.01-0.3 wt. % in terms of nitrogen content;

b) an alkaline earth metal-containing detergent in an amount of 0.08-0.3 wt. % in terms of alkaline earth metal content;

c) a phosphorus-containing wear inhibitor in an amount of 0.05-0.12 wt. % in terms of phosphorus content;

d) an oxidation inhibitor selected from the group consisting of amine compounds, phenol compounds, and molybdenum compounds, in an amount of 0.1-7 wt. %, and e) a viscosity index improver in an amount of 0.5-20 wt. %, wherein the amounts of the additive components are in terms of wt. % based on a total amount of the lubricating oil composition.

2. The lubricating oil composition of claim 1, which comprises a mineral base oil showing a kinematic viscosity in the range of 5 to 9 $mm^2/s$ at 100° C. and a viscosity index in the range of 133 to 160.

3. The lubricating oil composition of claim 1, wherein the base oil shows a viscosity index in the range of 133 to 160 and is produced by subjecting slack wax or synthetic wax obtained by Fischer-Tropsch process to a hydrogenation-isomerization process, distillation and dewaxing.

4. The lubricating oil composition of claim 1, which contains an organic sulfur-containing compound.

5. The lubricating oil composition of claim 1, which is used for lubricating motorcycles equipped with a four cycle gasoline engine.

6. The lubricating oil composition of claim 1, which is used for lubricating a diesel engine mounted on motor cars equipped with an exhaust gas post-processing apparatus.

7. A method of lubricating a four cycle gasoline engine of a motorcycle with the lubricating oil composition of claim 1.

8. A method of lubricating a diesel engine mounted on motor cars equipped with an exhaust gas post-processing apparatus employing the lubrication oil composition of claim 1.

9. The lubricating oil composition of claim 1, wherein the viscosity index improver is selected from the group consisting of a polymethacryl viscosity index improver, an olefin copolymer viscosity index improver and mixtures thereof.

10. The lubricating oil composition of claim 9, wherein the polymethacryl viscosity index improver is a polymethacrylate viscosity index improver.

11. The lubricating oil composition of claim 9, wherein the olefin copolymer viscosity index improver is selected from the group consisting of an ethylene-propylene copolymer viscosity index improver, styrene-butadiene copolymer viscosity index improver, polyisoprene viscosity index improver and mixtures thereof.

* * * * *